United States Patent [19]

Tufts

[11] Patent Number: 4,550,452

[45] Date of Patent: Nov. 5, 1985

[54] TOILET SYSTEM

[75] Inventor: Wesley M. Tufts, Holliston, Mass.

[73] Assignee: Control Fluidics, Inc., Greenwich, Conn.

[21] Appl. No.: 575,072

[22] Filed: Jan. 30, 1984

[51] Int. Cl.[4] ..... E03D 9/10

[52] U.S. Cl. ..... 4/319; 4/323

[58] Field of Search ..... 4/300, 319, 320, 321, 4/323, 340–342, 415, 195, 197, 204; 417/201, 203, 362; 210/104

[56] References Cited

U.S. PATENT DOCUMENTS

| | | | |
|---|---|---|---|
| 1,899,563 | 2/1933 | Eaton | 417/362 |
| 3,216,768 | 11/1965 | Soeding et al. | 417/203 |
| 3,228,036 | 1/1966 | Zaske et al. | 4/320 |
| 3,275,550 | 9/1966 | Daubenspeck | 4/319 |
| 3,605,130 | 9/1971 | Russell | 4/320 |
| 4,054,519 | 10/1977 | Tufts | 210/104 |
| 4,333,185 | 6/1982 | Heinze et al. | 4/319 |
| 4,377,874 | 3/1983 | Tufts | 4/320 |

FOREIGN PATENT DOCUMENTS

WO83/0167 4/1983 PCT Int'l Appl. ..... 4/319

*Primary Examiner*—Stephen Marcus
*Assistant Examiner*—Linda J. Sholl
*Attorney, Agent, or Firm*—Robert T. Gammons

[57] ABSTRACT

A toilet system comprising a bowl, a treating chamber, a trap connecting the bowl to the treating chamber, said trap containing a bypass to a waste pipe, a conductor connecting the treating chamber to the waste pipe, a hydraulic attrition member in the treating chamber for particulizing effluent delivered into the treating chamber, a worm pump in the treating chamber for evacuating effluent from the bowl into the treating chamber and discharging the treated effluent into the waste pipe, a valve connected to the bowl for supplying flush water thereto and control means operable to initiate operation of the pump followed by operation of the valve and stop the pump prior to closing of the valve and wherein, in the event the pump is disabled, discharge from the bowl can be effected through the bypass by delivery of fluid into the bowl.

3 Claims, 11 Drawing Figures

TOILET SYSTEM

BACKGROUND OF THE INVENTION

In my U.S. Pat. No. 4,333,185, dated June 8, 1982, there is shown and described a water saving toilet system. The system herein illustrated is similar in many respects to that shown in the aforesaid patent, but improved in certain aspects, particularly in that it is provided with improved pump means for evacuating the bowl, with an improved discharge opening at the bottom of the bowl to insure complete removal of solids from the bowl, with improved bypass means for bypassing the effluent from the bowl in the event of pump failure, with an improved treating chamber to provide for more efficient attrition and discharge of the treated fluid, with improved drive means for driving both the attrition member and pump from a common motor, and improved construction such as to enable dismantling the attrition member and pump from the treating chamber easily and quickly to permit cleaning and/or repair.

SUMMARY OF THE INVENTION

As herein illustrated, the toilet system comprises a toilet bowl having at the bottom a discharge opening, a treating chamber having an intake opening, a conductor connecting the discharge opening of the bowl to the inlet opening of the treating chamber, an attrition member in the chamber, a pump in the chamber for discharging treated effluent therefrom into a waste pipe, a motor, means drivably connecting the attrition member and discharge pump to the motor for effecting simultaneous operation of the attrition member and pump, a valve connecting the bowl to a source of water operable to admit water to the bowl and means for sequencing operation of the valve and motor to initiate operation of the discharge pump followed by operation of the valve to supply flush water to the bowl, terminate operation of the discharge pump and then close the valve.

The treating chamber is divided medially by a baffle into the attrition chamber and a pump chamber such that the attrition member is housed in the attrition chamber and the pump is housed in the pump chamber. The baffle is perpendicular to the bottom of the treating chamber, has a transverse, horizontally-disposed, rectilinear upper edge adjacent the top of the treating chamber and a lower edge, a portion of which is parallel to the bottom and a portion of which is inclined thereto, which defines a relatively restricted opening at the bottom from the attrition chamber to the pump chamber.

The attrition member is in the form of a flat disk rotatably supported in the attrition chamber above the bottom for rotation in a horizontal plane and has at its peripheral edge beater blades which function to break up the solids by hydraulic impact. Desirably, the bottom of the attrition chamber below the blade is of relatively flat, annular configuration with a capstan centered therein below the blade.

The discharge pump is a worm pump provided with an intake opening in communication with the interior of the treating chamber and a discharge opening in communication with the waste pipe.

The means connecting the bowl to the treating chamber is a trap provided with a vertical leg, the lower end of which is connected to the discharge chamber and there is a bypass conductor connecting the vertical leg of the trap to the waste pipe containing a valve characterized in that it is supported in a position such that it is normally held closed by gravity. The discharge opening from the bowl to the trap is of non-circular configuration defines by a transverse, horizontal, rectilinear upper edge and a transverse, arcuate lower edge. Desirably, the treating tank is provided with a removably attached cover at the top provided with spaced, parallel, vertically-positioned bearing sleeves. There are shafts journaled in said sleeves which extend through the cover member into the treating chamber to which the attrition member and pump are connected. There are pulleys fixed to the shafts externally of the treating tank, a belt entrained about the shafts and a coupling connecting one of the shafts to a drive motor by means of which the two shafts are driven simultaneously.

The invention will now be described in greater detail with reference to the accompanying drawings, wherein.

Figure 1:
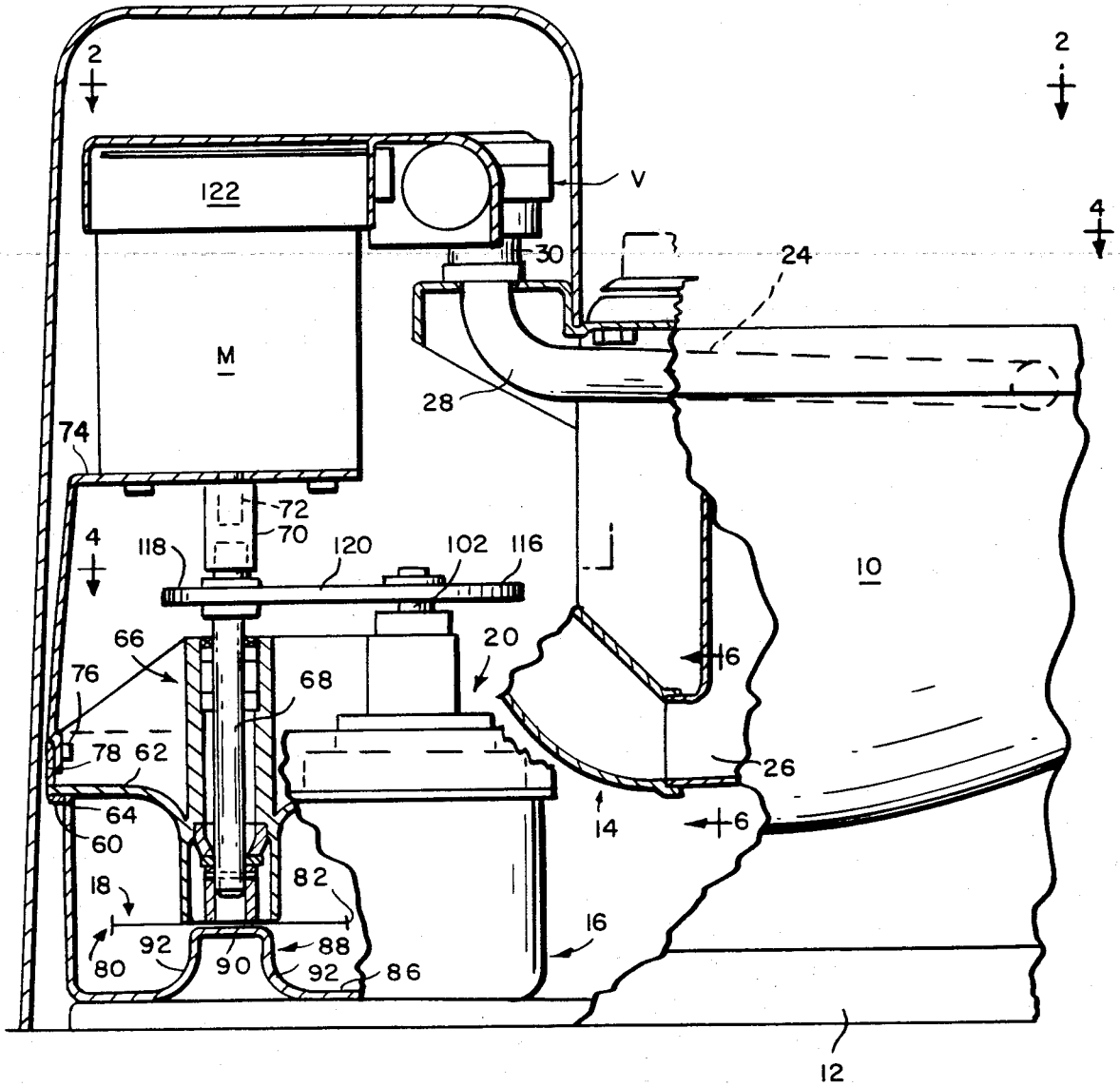
FIG. 1 is a side elevation partly in section of the improved toilet system of this invention.
Figure 2:
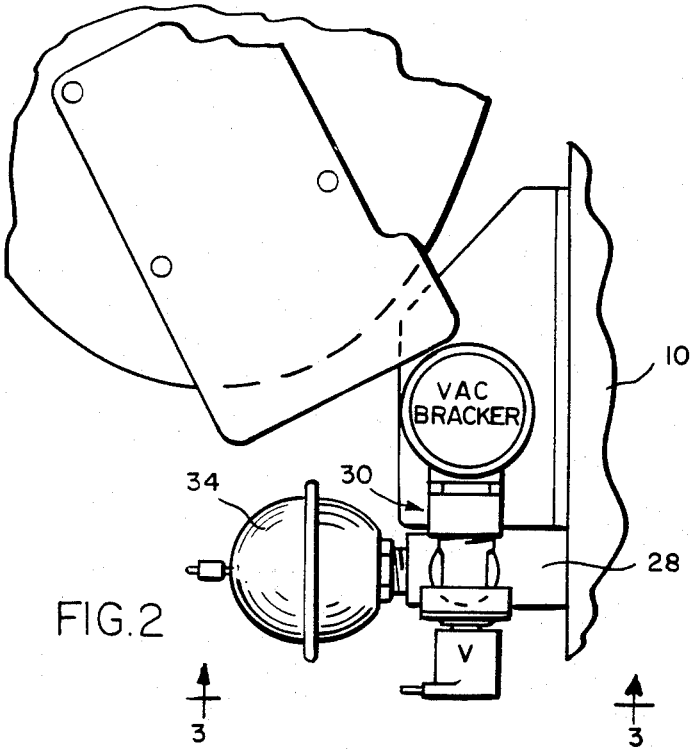
FIG. 2 is a fragmentary plan view taken on the line 2—2 of FIG. 1 with the mantel removed.
Figure 3:
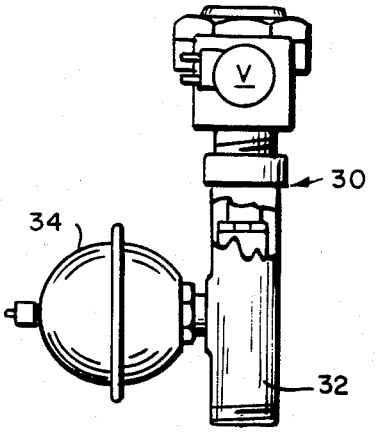
FIG. 3 is an elevation partly in section taken on the line 3—3 of FIG. 2.
Figure 9:
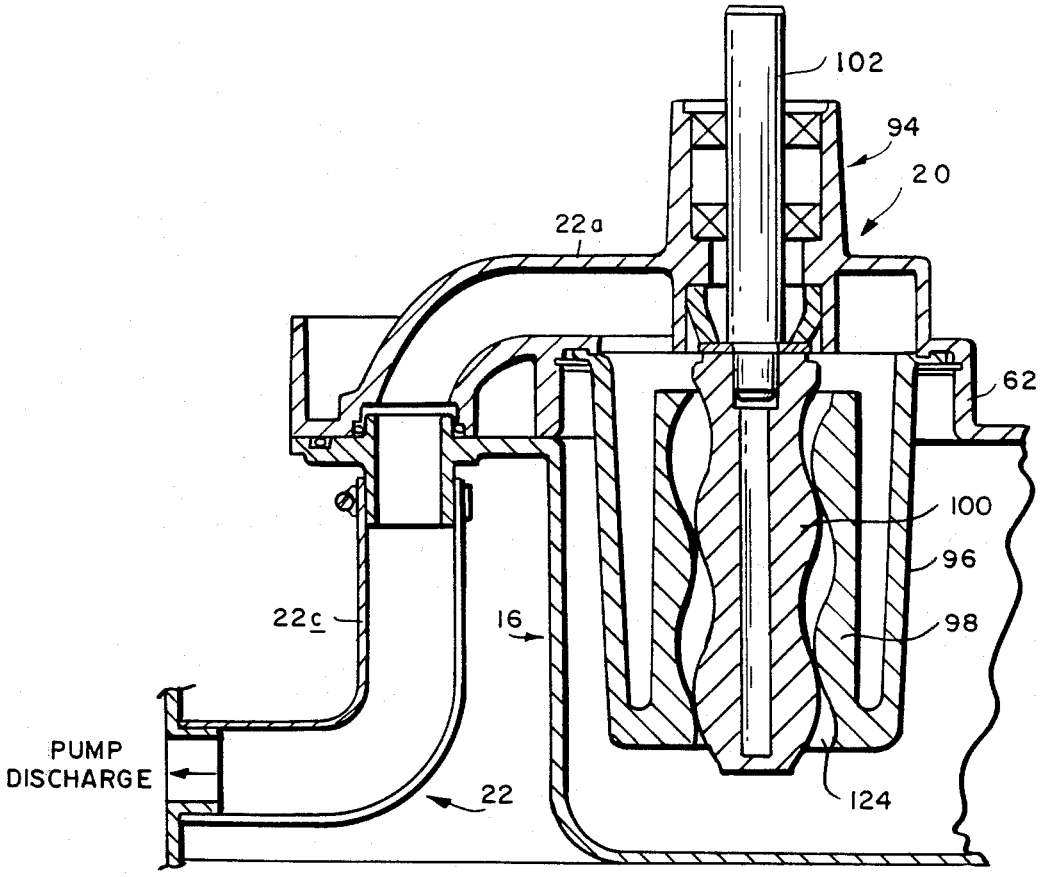
FIG. 9 is a vertical section through the pump assembly.

Referring to the drawings, FIG. 1, there is shown a toilet bowl 10 supported on a suitable base 12 to which flush water is supplied by a solenoid-operated valve V, FIGS. 1 and 3, and from which effluent is discharged through a trap 14 into a treating chamber 16 where it is subjected to hydraulic attrition by a beater blade 18 and then pumped by means of a pump 20, FIGS. 1 and 9 through a discharge conductor **22*a* and bypass 22*b*** to a soil pipe.

Figure 4:
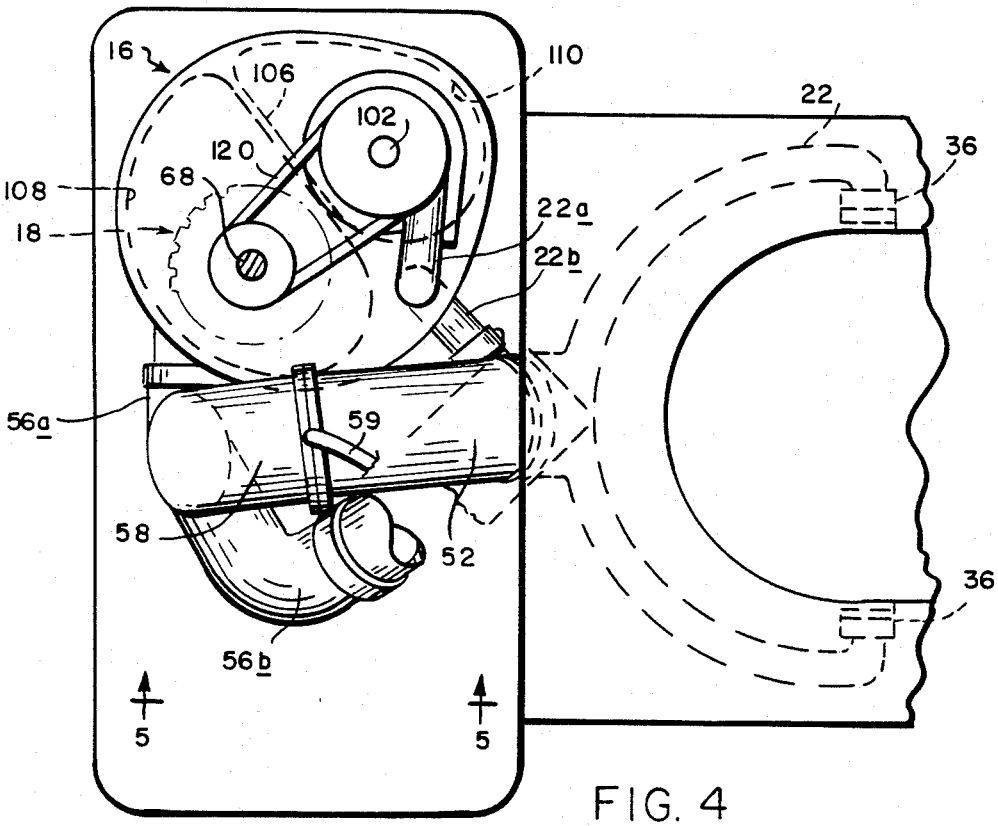
FIG. 4 is a fragmentary plan taken on the line 4—4 of FIG. 1.

The bowl 10 is of generally conventional configuration, has at the top a cored passsage 24 which, as shown in FIGS. 1 and 4, extends peripherally around the rear half of the bowl, through which flush water is delivered to the bowl for flushing, and a discharge opening 26, FIG. 1, at the bottom through which effluent is discharged. The rear end of the cored passage 24 is connected by a feeder tube 28 and suitable plumbing 30 to the solenoid-operated valve V which, in turn, is connected to a water supply, now shown, by way of a pipe 32, FIG. 3, so that operation of the valve V will supply flush water to the cored passage. Desirably, a water hammer arrester 34 is inserted into the pipe 32. The forward ends of the cored passage 24 terminate diametrically opposite each other approximately halfway between the front and rear ends of the bowl in openings 36—36 within which are fixed spray nozzles 38—38 through which water delivered into the cored passage is ejected downwardly on the interior surface of the bowl.

Figure 10:
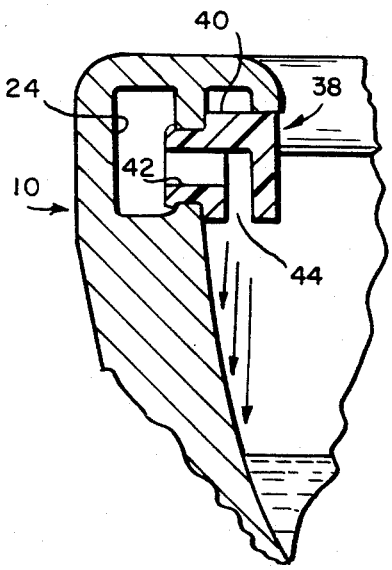
FIG. 10 is a fragmentary section of a spray head nozzle.

The nozzles 38—38 are of the kind shown in U.S. Pat. No. 4,404,696 and comprise, as shown in FIG. 10, cylindrical plugs 40 containing ports 42 which are in communication with the cored passage 24 and downwardly-opened slots 44 designed to eject the flush water downwardly in fan shape against the interior surface of the bowl so as to wash the surface down.

Figure 6:
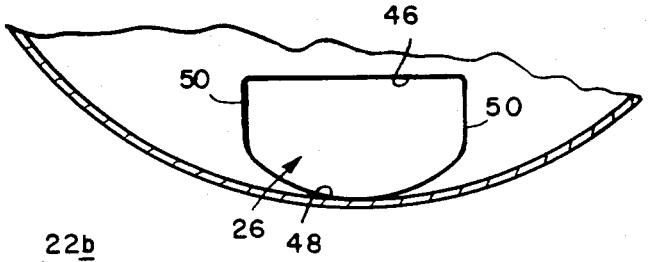
FIG. 6 is a fragmentary vertical section taken on the line 6—6 of FIG. 1.

The discharge opening 26 at the bottom of the bowl 10 according to the invention shown in FIG. 6 is of non-circular, vertical section defined by a transverse, horizontal, rectilinear top edge 46 and a transverse, arcuate lower edge 48 connected to the upper edge 46 by transversely-spaced, vertical end portions 50—50. The upper edge 46 is of greater length than the radius of the arc of the lower edge and the vertical distance from the upper edge to the lower edge is shorter in length than the radius of curvature of the lower edge. The opening is configured to maximize the vacuum effect of the trap to ensure complete removal of effluent, particularly solids which tend to settle at the bottom of the bowl.

Figure 5:
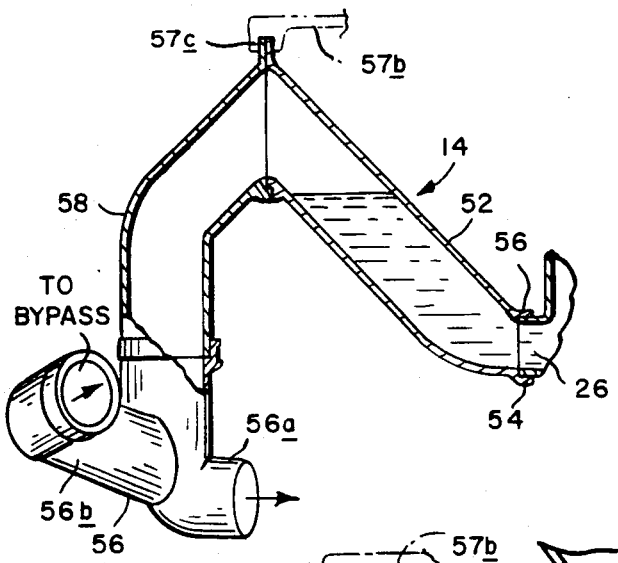
FIG. 5 is an elevation partly in section taken on the line 5—5 of FIG. 4.
Figure 7:
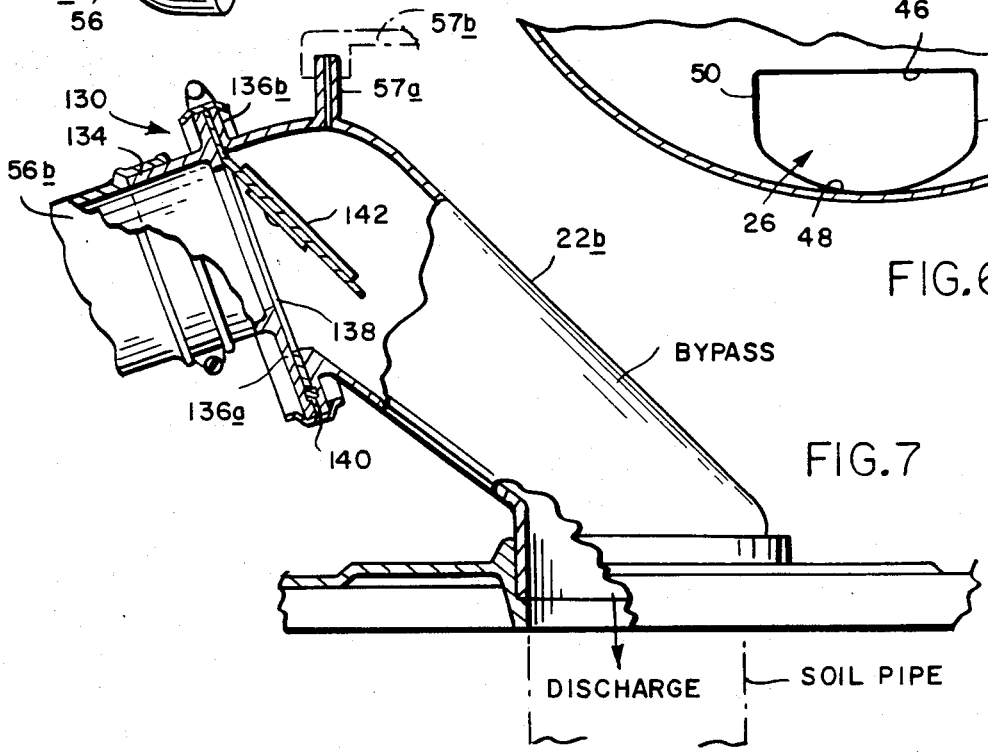
FIG. 7 is a fragmentary vertical section taken on the line 7—7 of FIG. 4.

The trap 14, as shown in FIG. 5, for conducting the effluent from the bowl to the treating chamber has an upwardly-inclined leg 52, the lower end of which is flanged at 54 to fit over an extension 56 defining the opening 26 and a vertical leg 58 connected at its upper end to the upper end of the inclined leg 52 and at its lower end to the treating chamber 16 by way of a yoke 56 embodying a leg **56*a* which is connected directly to the treating chamber 16 and a leg 56*b* which is connected by means of a valve assembly 130, which will be described hereinafter, to the bypass 22*b*, FIG. 7**.

The treating chamber 16 is mounted on the supporting structure 12 for the bowl behind the bowl 10 and, as shown in FIG. 4, is of generally circular cross section, is closed at the bottom and has an open top, peripherally of which there is a rim 60, FIG. 1. A cover plate 62 is mounted on the rim 60 and secured thereto by suitable means. Desirably, a sealing ring 64 is recessed into the flange 60 to provide a tight joint between the flange 60 and the cover plate. The cover plate 62 supports the beater blade 18, the pump 20 and the drive means therefor comprising a motor M and driving connections. As illustrated, the cover plate 62 has formed integral therewith a vertical bearing assembly 66 which rotatably supports a shaft 68 with a portion extending above the treating chamber and a portion extending into the treating chamber. The portion of the shaft 68 extending above the treating chamber is fixed by a coupling 70 to the drive shaft 72 of the motor M, the latter being mounted above the upper end of the shaft 68 on a bracket 74 removably fastened by bolts 76 to a peripheral flange 78 at the edge of the cover plate 62. The portion of the shaft 68 extending into the treating chamber has fixed to it the beater blade 18 disposed in a horizontal position at right angles to the axis of the shaft, at the peripheral edge of which there are beater members 80 in the form of upwardly and downwardly-projecting fins 82 of a configuration and disposition as shown, for example, in U.S. Pat. No. 4,054,519. Optionally, the fins 82 may be confined to the top side or the bottom side. Below the beater blade 18, the bottom of the treating chamber is structured to provide a generally flat, annular, toroidal surface 86, at the center of which there is a capstan 88 having an upper horizontal portion 90 parallel to and adjacent the lower side of the blade 18 and a concave side portion 92—92 which merge with the flat bottom surface 86. The blade 18 and the subjacent toroidal surface defined by the surfaces 86, 90 and 92 provide for hydraulic attrition of the effluent delivered into the treating chamber. The blade 18 operates by hydraulic attrition rather than cutting to disperse and particulate the solids in the effluent.

The cover plate 62 is also provided with a bearing assembly 94, FIG. 9, for receiving the pump assembly 20. The bearing assembly is formed integral with the cover plate 62 and comprises a sealed housing 96 within which there is a stator 98 and a rotor 100. The upper end of the rotor 100 is fixed to a shaft 102 journaled in the bearing assembly 94. The stator and rotor constitute, in conjunction, a worm pump.

Figure 8:
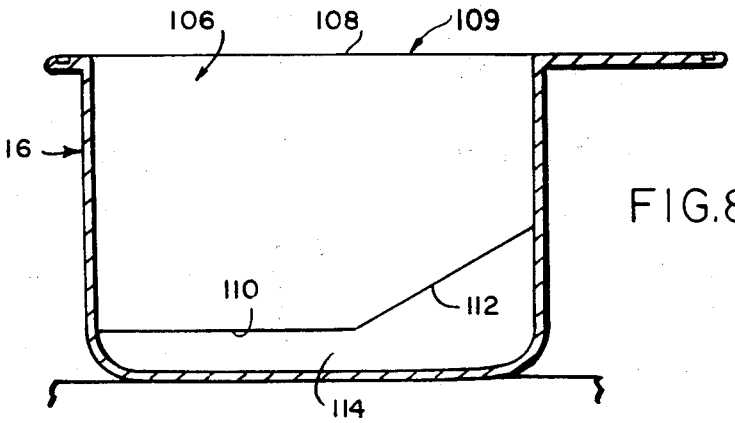
FIG. 8 is a vertical section through the treating chamber showing the divider in elevation

The treating chamber 16, as shown in FIG. 4, is divided medially by a baffle plate 106, FIG. 8, into an attrition chamber 108 within which the beater blade is mounted and a pump chamber 110 within which the pump 20 is mounted. The baffle plate 106 divides the treating chamber 16 into two chambers of somewhat oval configuration. The baffle plate 106, as shown in FIG. 8, has an upper horizontal edge 109 which coincides substantially with the top of the treating chamber 16 and a lower edge comprising a horizontal portion 110 parallel to the bottom and an upwardly-inclined portion 112. The edges 110 and 112 define with the bottom an opening 114 from the attrition chamber to the pump chamber which is relatively narrow throughout a portion of its length and wider the remainder of its length. The baffle plate 106 isolates the beater blade from the pump so that optimum beating action can take place in the attrition chamber 108 and optimum pumping can be achieved in the pump chamber 110 without interference. The narrow opening 114 contains the effluent in the attrition chamber so that it is subjected to hydraulic attrition while permitting passage of materials, for example, paper tissue, which fails to be broken up.

A pulley 116 is fixed to the upper end of the shaft 102, a pulley 118 is fixed to the upper end of the shaft 68 and a belt 120 is entrained about the pulleys so that the motor M drives the blade 18 and the pump 20 simultaneously. A control module 122 is mounted on top of the motor M for controlling operation when a flushing cycle is initiated, as will be described in conjunction with the control circuitry shown in FIG. 11.

The pump 20 has an intake port 124, FIG. 9, within the pump chamber 110. The discharge conductor **22*a* from the pump is connected by a conductor 22*c* to the bypass 22*b*** and this, in turn, is connected to a waste pipe.

As shown in FIG. 5, the leg **56*b* is connected at one end directly to the vertical leg 58 of the trap and at its other end by means of the valve assembly 130 to the bypass 22*b*. A vent 57*a* at the top of the bypass 22*b* is connected by a conductor 57*b* to a vent 57*c* at the top of the trap. The valve assembly comprises a coupling member 134 provided with a flange 136*a*. The adjacent end of the bypass 22*b* embodies a flange 136*b* and a valve seat ring 138 is disposed between the flanges and secured thereto by a clamping ring 140. A flexible flapper valve member 142 is positioned between the flanged and held clamped therebetween by the clamping ring 140. The coupling member 134 is removably clamped to the leg 56*b* and is inclined upwardly with respect to the vertical axis of the bypass 22*b* so that the flange 132*a* slopes with respect to the vertical. The flange 136*b* at the end of the bypass 22*b* is at an angle such as to be parallel to the flange 132*a*. The flexible flapper valve member 142 is arranged to open inwardly with respect to the bypass 22***b* by a pressure head within the vertical leg of the trap and to close by gravity in the absence of a head of the vertical portion of the trap. Normally, when the pump is in operation, it produces a low pressure in the vertical leg of the trap so that low pressure, in conjunction with the gravitational disposition of the valve member 142, insures that the valve will be held closed under normal conditions. An angular disposition of the valve is of importance to prevent siphoning of the effluent from the vertical leg of the trap when the system is at rest. When the system is in use and for some reason the pump becomes disabled, a pressure head developed in the vertical leg of the trap will open the flapper valve 142 and allow the effluent to flow directly through the bypass 22*b* to the waste pipe. A pressure head can be provided by dumping water into the bowl or, if the valve is operative, supplying water to the bowl through the valve. The provision of the bypass enables flushing the system if the pump becomes disabled.

Figure 11:
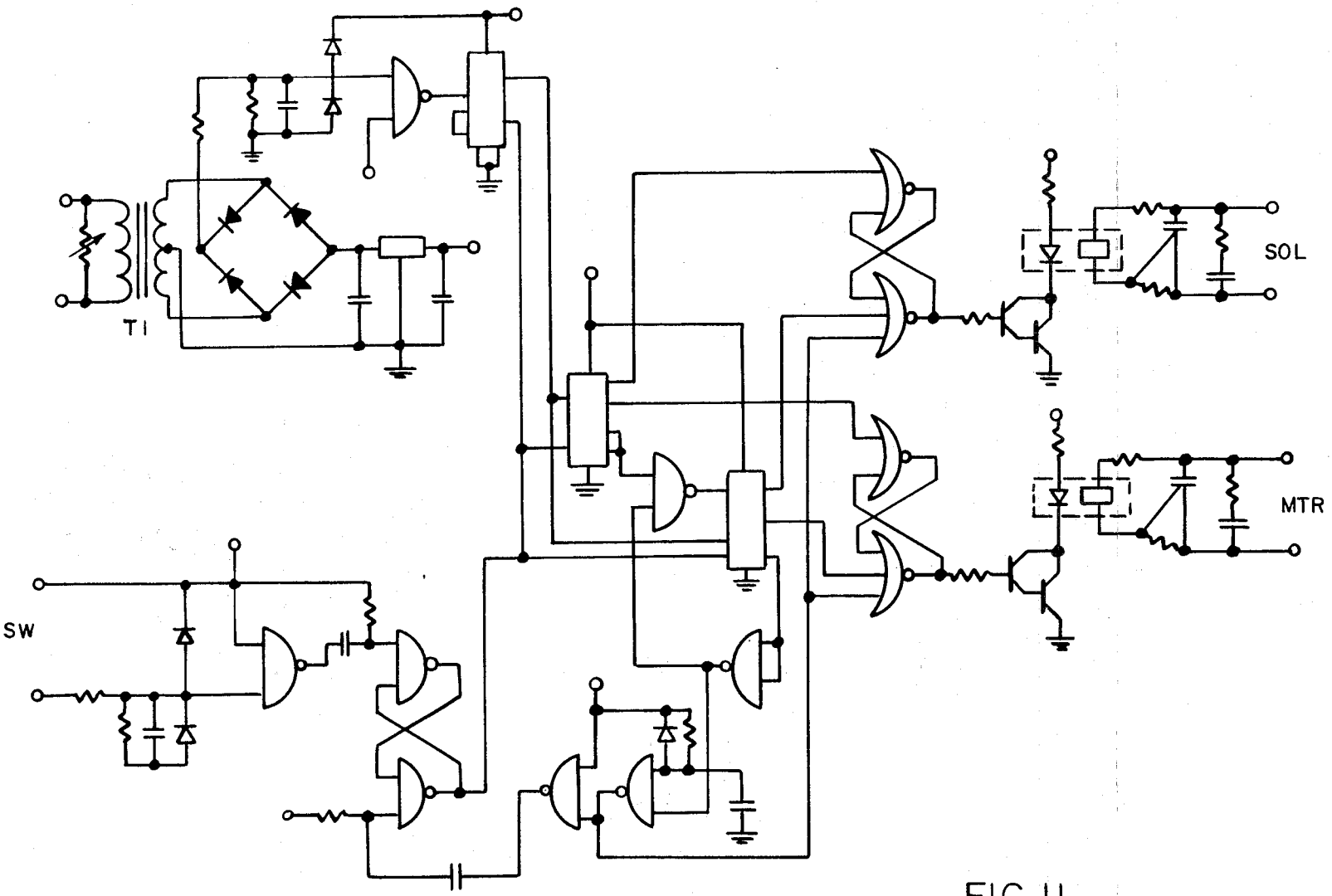
FIG. 11 is a control circuit diagram for controlling the sequence of operation.

The system, in normal operation, is sequenced by control circuitry housed in the module 122 so that the discharge pump 20 is started first, followed by energization of the solenoid-operated valve V for supplying flush water to the bowl. When a flush cycle is completed, the discharage pump stops first, followed by closing of the valve V. The attrition blade 18 is in operation during the entire time that the pump is in operation. FIG. 11 depicts the control circuit diagram which provides for sequencing operation of the valve V and pump 20 so as to start the pump before opening the valve V and to stop the pump before closing the valve. In this circuit, there is shown the terminals SW for the switch which initiate a cycle of operation, the terminals MTR for the motor M, the terminals SOL for the solenoid valve V and transformer terminals T1 for supplying power to the circuitry.

In prior toilet systems of this kind, the discharge opening 26 from the toilet bowl to the trap has always been of circular cross section. Because of this configuration, when the water in the inclined leg of the trap falls below the top of the discharge opening, the vacuum is broken and, hence, the normal siphoning action of the effluent in the trap fails to completely evacuate the bowl and, in consequence, some solid matter remains at the bottom of the bowl. By changing the cross section of the opening 26 from circular to that shown herein so that the upper curved portion is replaced by a horizontal edge below the center of curvature of the arcuate lower edge, the vacuum can be maintained for a sufficient length of time to insure complete evacuation of the bowl.

Also, in prior devices of this kind, the impeller and the pump have been located in a common treating chamber, with the result that there has been some interference in the function of the two structures, to wit, the beater blade and pump, with incomplete particularization of the effluent and inefficient pumping. The provision of the baffle 106 described above alleviates this problem, confining the effluent within the sphere of operation of the beater blade 18 so that there is no possiblity of bypassing the beater blade directly to the intake of the pump.

It should be understood that the present disclosure is for the purpose of illustration only and includes all modifications or improvements which within the scope of the appended claims.

What is claimed is:

1. A toilet system comprising a toilet bowl having at the bottom a discharge opening, a treating chamber having an intake opening, a conductor connecting the discharge opening of the bowl to the intake opening of the treating chamber, an attrition member in the treating chamber, a discharge pump in the treating chamber for discharging treated effluent therefrom into a waste pipe, said conductor comprising a trap through which effluent is inducted by the discharge pump and a bypass conductor connected at one end to the trap and at its other end to the waste pipe containing a valve held closed by low pressure developed in the treating chamber by the discharge pump which is free to open in the event of a pressure head in the trap and a vent pipe connecting the top of the trap to the bypass conductor, a motor, means drivably connecting the attrition member and discharge pump to the motor for effecting simultaneous operation of the attrition member and the discharge pump, a valve connecting the bowl to a source of water operable to admit water to the bowl and means for sequencing of the valve and the motor to initiate operation of the attrition member and discharge pump, followed by operation of the valve to supply flush water to the bowl, terminate operation of the discharge pump and then close the valve.

2. A toilet system comprising a toilet bowl having at the bottom a discharge opening, a treating chamber having an intake opening, a conductor connecting the discharge opening of the bowl to the intake opening of the treating chamber, an attrition member in the treating chamber, a discharge pump in the treating chamber for discharging treated effluent therefrom into a waste pipe, said conductor comprising a trap through which effluent is inducted by the discharge pump having a vertical leg, to the lower end of which is connected the treating chamber, and a bypass conductor connecting the vertical leg of the trap to a waste pipe containing a valve, characterized in that the valve is supported in the bypass conductor at an angle to the axis of the leg such that it is gravitationally held in a closed position.

3. A toilet system comprising a toilet bowl having at the bottom a discharge opening, a trap, a treating chamber having an intake opening, a conductor connecting the discharge opening of the bowl to the intake opening of the treating chamber, an attrition member in the treating chamber, a discharge pump in the treating chamber for discharging treated effluent therefrom into a waste pipe, said conductor comprising a trap through which effluent is inducted by the discharge pump having a vertical leg, the lower end of which is connected to the treating chamber, a bypass conductor connecting the vertical leg of the trap to the waste pipe containing a valve assembly comprising a valve seat defining a valve-controlled opening in the bypass and a valve member supported by engagement with the seat to close the opening, characterized in that the assembly is positioned at an angle such that the valve member is normally held closed by gravity, a motor, means drivably connecting the attrition chamber and the discharge pump to the motor for effecting simultaneous operation of the attrition member and the discharge pump, a valve connecting the bowl to a source of water operable to admit water to the bowl and means for sequencing operation of the valve and the motor to initate operation of the attrition member and discharge pump, followed by operation of the valve to supply flush water to the bowl, terminate operation of the discharge pump and then close the valve.

* * * * *